US005205771A

United States Patent [19]

Sims

[11] Patent Number: 5,205,771

[45] Date of Patent: Apr. 27, 1993

[54] TOY BOMBER FOR GENERATING SMOKE-FILLED BUBBLES

[76] Inventor: Anson Sims, 12708 Darla Ave., Granada Hills, Calif. 91344

[21] Appl. No.: 833,555

[22] Filed: Feb. 10, 1992

[51] Int. Cl.[5] ..... A63H 33/28; A63H 33/14; A63H 29/10

[52] U.S. Cl. ..... 446/21; 446/24; 446/25; 446/197

[58] Field of Search ..... 446/15, 16, 17, 18, 446/19, 20, 21, 24, 25, 193, 197

[56] References Cited

U.S. PATENT DOCUMENTS

| | | | |
|---|---|---|---|
| 554,555 | 2/1896 | Whaley | 446/21 |
| 697,063 | 4/1902 | Alhart | 446/20 |
| 823,388 | 6/1906 | Blonde | 446/20 |
| 1,710,609 | 4/1929 | Colwell | 446/20 |
| 2,409,471 | 10/1946 | Brosseit | 446/24 |
| 2,566,296 | 9/1951 | Brosseit | 446/21 |
| 2,832,173 | 4/1958 | Winfield | 446/16 |
| 2,912,790 | 11/1959 | Weeber | 446/18 |
| 4,276,713 | 7/1981 | Crosbie | 446/21 |
| 4,741,717 | 5/1988 | Wolf | 446/24 |
| 4,804,346 | 2/1989 | Sheng | 446/19 X |

FOREIGN PATENT DOCUMENTS

| | | | |
|---|---|---|---|
| 701299 | 12/1953 | United Kingdom | 446/20 |
| 2042350 | 9/1980 | United Kingdom | 446/21 |

*Primary Examiner*—Robert A. Hafer
*Assistant Examiner*—D. Neal Muir
*Attorney, Agent, or Firm*—Price, Gess & Ubell

[57] ABSTRACT

A device or machine for producing smoke-filled soap bubbles is provided. The device includes an air pumping mechanism such as an air bellows and a smoke-generating mechanism such as conventionally found in toy trains. The air pumping mechanism and the smoke-generating mechanism are connected to a tube or conduit having an open aperture. A soapy liquid film is provided on the aperture. Then the soap-generating mechanism and the air pump mechanism are simultaneously activated to pump smoke-filled air through the conduit to inflate the soap film into a soap bubble. The resulting soap bubble is thereby filled with smoke, thus producing a desirable effect. The device is preferably configured in the shape of a toy airplane such that the smoke-filled bubbles, when produced, appear as bombs dropped from the airplane.

3 Claims, 2 Drawing Sheets

TOY BOMBER FOR GENERATING SMOKE-FILLED BUBBLES

BACKGROUND OF THE INVENTION

1. Field of the Invention

The invention generally relates to devices for generating bubbles and, in particular, to toys for generating bubbles.

2. Description of Related Art

A variety of devices have been designed for producing one or more bubbles, either simultaneously or in succession. Examples range from simple mechanical rings which are dipped into a soapy liquid, then passed through the air to generate a succession of bubbles, to complicated automatic bubble-making devices for automatically producing hundreds of bubbles.

Additionally, various devices have been developed which include some form of a smoke-generating device. Examples include toy trains and toy boats wherein a small amount of smoke is generated within a smoke stack of the toy for producing the illusion of self-propulsion.

However, heretofore no devices have been devised combining a bubble-making apparatus with a smoke-generating device to produce soap bubbles filled with smoke.

SUMMARY OF THE INVENTION

Accordingly, it is an object of the invention to provide a device or machine for producing smoke-filled bubbles;

It is a further object of the invention to provide such a device with an air pump mechanism such as an air bellows for producing an air flow sufficient to form bubbles; and It is a further object of the invention to configure the bubble-generating device in the form of a toy airplane, toy bomber, or the like.

These and other objects of the invention are achieved by a device having a means for generating smoke, a means for producing a bubble, and a means for injecting the smoke into the bubble as the bubble is produced.

In accordance with a preferred embodiment, the device or machine includes a means for pumping a gas connected to a conduit terminating in an aperture. An expandable, flexible film is disposed on the aperture. The means for pumping gas pumps the gas through the conduit, past the aperture, to inflate the film into a bubble, balloon, or the like. A smoke-generating means is also connected to the conduit for generating smoke to fill the conduit with smoke while the film is being inflated, such that the smoke fills the resulting bubble or balloon. The film may be a soap film, and the gas may be air, such that the resulting bubble is a soap bubble.

Once a smoke-filled bubble is produced of suitable size, the bubble is detached to yield a free-floating smoke-filled bubble. The thus-produced bubble retains the smoke until the bubble bursts, releasing the smoke and producing a desirable visual effect.

The device may be configured in the shape of a toy airplane or toy bomber such that the smoke-filled bubbles appear as bombs dropped from the airplane.

The device may be configured to sequentially produce a plurality of bubbles of various sizes. The smoke-generating means may be connected to the air pump means to activate the smoke-generating means only when the means for pumping air is in use. Thus smoke is generated only when needed.

Also, the device may include a chamber for storing a quantity of soapy liquid. The chamber, the conduit, or both may be configured to pivot to enable the aperture of the conduit to be easily inserted into the chamber, for conveniently providing a soap film covering aperture.

Thus, the invention provides a simple and effective device or machine for generating smoke-filled bubbles. The mechanism is inexpensively constructed of durable parts.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a device for generating smoke-filled bubbles.

Figure 1:
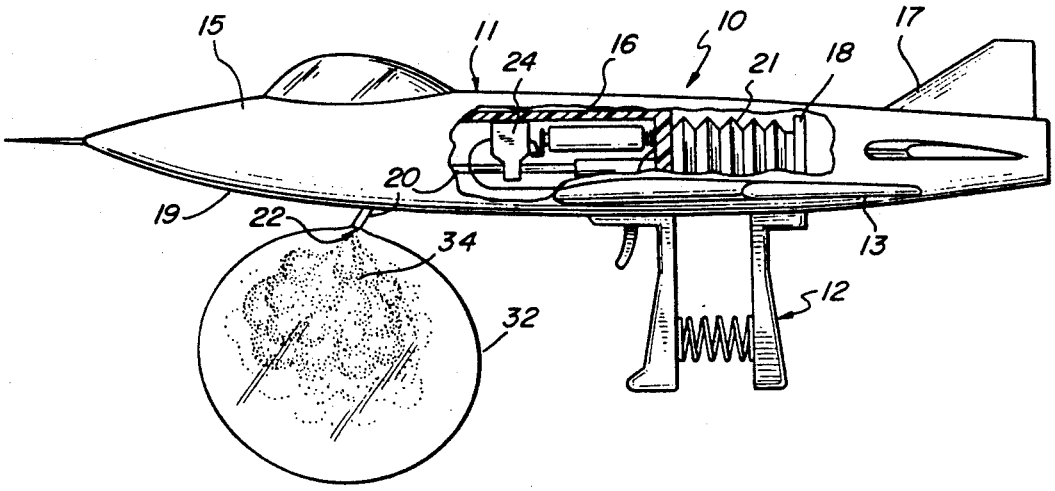
FIG. 1 is a side view, partially in cutaway, of a bubble machine constructed in accordance with a preferred embodiment of the invention, shown with an inflated smoke-filled bubble.

In FIG. 1, a machine or device 10 is shown for producing smoke-filled bubbles. Device 10 is mounted within a body 11, preferably constructed of a resilient plastic, and generally configured in the shape of a toy airplane. Portions of body 11 form wings 13, fuselage 15, and tail 17.

A pistol grip 12 extends from beneath fuselage 15 and is sized for gripping by a hand, preferably that of a child. Pistol grip 12 is operably connected to an air bellows 21. Remaining components of the device are contained within an enclosure 16 within fuselage 15.

A conduit or tube 20 having an open aperture 22 extends from enclosure 16 through a bottom surface 19 of fuselage 15.

An inner end of conduit 20 is connected to a smoke-generating chamber 24. A second conduit 23 connects air bellows 21 to an opposite side of smoke-generating chamber 24. Conduit 20, smoke-generating chamber 24, and air bellows 21 form a channel for pumping a gas such as air from the air bellows through the smoke-generating chamber into the conduit, and ultimately through the aperture.

In use, aperture 22 of conduit 20 is dipped into a soapy solution (not shown in FIG. 1) to produce a soap film covering aperture 22. Once aperture 22 is covered with a soap film, smoke-generating device 24 is activated and air bellows 21 is manually pumped by squeezing pistol grip 12 to pump air through conduit 20 past aperture 22.

As the pumped air passes through smoke-generating chamber 24, smoke 34 becomes entrained within the pumped air. The resulting air/smoke mixture inflates the soap film into a soap bubble 32. Air bellows 21 is repeatedly pumped by squeezing pistol grip 12 to inflate the resulting smoke-filled air bubble 32 to a desired size.

Once smoke-filled bubble 32 has achieved a desired size, the bubble is detached from the device, either by sharply withdrawing the device, or by blowing directly on the bubble until it is dislodged. The presence of smoke in the bubble causes the bubble to be heavier than air such that, once dislodged, the bubble drops from beneath fuselage 15 to the floor or ground.

The dropping smoke-filled bubble will typically float downward for several seconds before striking a surface or object, at which time the bubble bursts. As bubble 32 bursts, smoke 34 entrapped within the bubble is released, producing a desirable visual effect resembling an explosion. Occasionally, the bubble will burst without striking a surface or object. Also, occasionally the bubble will rest against a surface or object before bursting, thus producing a desirable delayed explosion.

The smoke-filled bubbles are typically two to four inches in diameter.

Once a first bubble is produced and dislodged from device 10, aperture 22 may be redipped into the soapy liquid and the process repeated to produce additional bubbles. Under certain circumstances, a series of successively-produced bubbles may be produced from a single dipping of aperture 22 into the soapy liquid. Such is most likely to occur with a high air flow through conduit 20 caused by vigorous pumping of air bellows 21.

Figures 2, 3, 4:
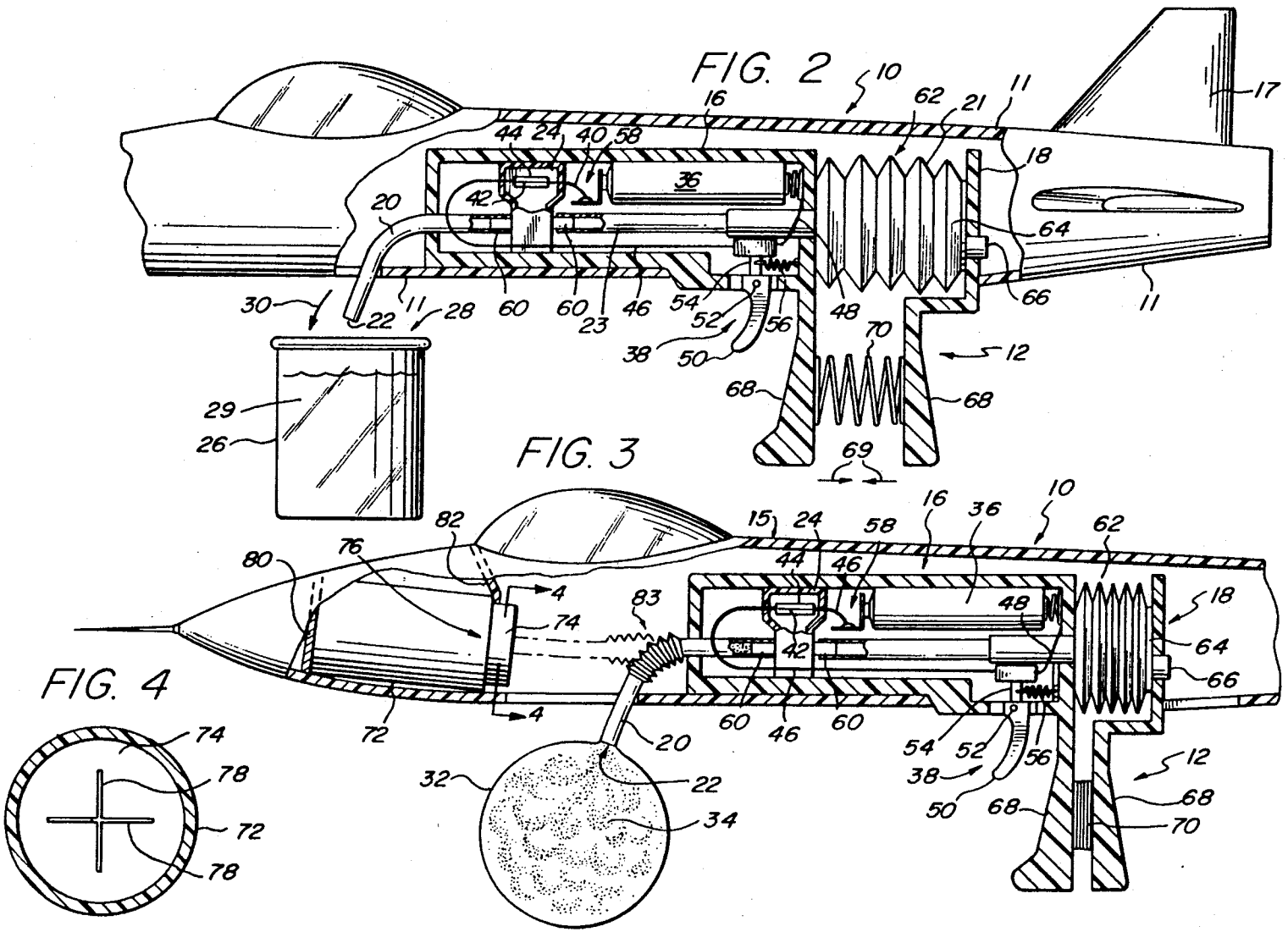
FIG. 2 is a side view, partially in cross-section, of a portion of the bubble machine of FIG. 1, shown prior to inflation of a bubble.
FIG. 3 is a side view, partially in cross-section, of an alternative embodiment of FIG. 1, having an internally mounted soapy-liquid chamber, the machine shown producing a smoke-filled soap bubble.
FIG. 4 is a side view, taken on line 4—4 of the container of FIG. 3.

The various components of device 10 will now be described in greater detail with reference to FIGS. 2 and 3, showing a closeup view of device 10 and a portion of surrounding body 11. FIG. 3 provides an alternative embodiment of FIGS. 1 and 2.

In addition to smoke-generating chamber 24, barrel 16 includes a battery 36 and a trigger switch 38. A wire 40 connects a first lead of battery 36 into smoke-generating chamber 24 to one end of a wire filament 42. Filament 42 is surrounded by a fibrous material 44 soaked in a heat-sensitive oil. A second wire 46 connects an opposite end of filament 42 to trigger switch 38. A third wire 48 connects trigger switch 38 to the negative lead of battery 36.

Trigger switch 38 includes a manually-operable trigger 50 pivotably connected at a pivot point 52 to an outside edge of body 11. An internal lever arm 54 is mounted to trigger 50 for forward movement as trigger 50 is depressed. Free ends of wires 46 and 48 are operably connected to lever arm 52 such that, when trigger 50 is depressed, lever 52 causes free end of wire 46 to contact the free end of wire 48, thus completing an electrical circuit, enabling current to be conducted through filament 42 within smoke-generating chamber 24. A spring 56 is connected to lever 52 to automatically withdraw lever 52 when trigger arm 50 is no longer depressed. Thus the electrical circuit is closed only while trigger 50 is depressed.

The oil-saturating fibrous sheath 44 comprises a conventional heat-sensitive oil which produces smoke when heated. As electrical contact passes through filament 42, electrical resistance within filament 42 produces heat which, in turn, heats fibrous sheath 44. The heat-sensitive oil responds to the heat by producing a smoke which fills chamber 24, as shown in FIG. 3. Filament 42, sheath 44, and the heat-sensitive oil are all of conventional composition and construction, and will not be described in further detail.

As shown in FIG. 1, smoke-generating chamber 24 and battery 36 are mounted within enclosure 16. Although not shown in FIG. 1, portion of shell 11 and enclosure 16 may include removable sections to allow access to battery 36 and smoke-generating chamber 24. In this manner, these components may be easily accessed and replaced.

Battery 36 comprises a conventional 1½-volt pen light battery. Alternatively, two or more pen light batteries may be connected in series within cavity 58 to produce additional electrical current.

Chamber 24 is preferably formed from an inexpensive plastic shell. Small openings are provided within the sides of the chamber to allow wires 40 and 46 to connect into chamber 24. Preferably, these small openings are sealed over to prevent smoke from leaking from the chamber. A pair of opposing tube mounts 60 facilitate connection of chamber 24 to conduits 20 and 23.

Air bellows 21 is a conventional inexpensive air bellows having a plurality of collapsible accordion-like ridges 62 forming a cylindrical chamber 64. A one-way vent 66 is attached to an outer side surface of chamber 64 to allow air to enter chamber 64 while bellows 21 is expanded. During contraction of bellows 21, vent 66 closes, thus forcing air contained within chamber 64 through conduit 23 into smoke-generating chamber 24, and subsequently into conduit 20, for inflation of a bubble.

Handle 12 includes a pair of gripping members 68 extending downwardly beneath bellows 21. A spring 70 is mounted between gripping members 68. In use, gripping members 68 are manually squeezed together, as shown by arrows 69, thus contracting bellows 21, to force air through aperture 22 to inflate the bubble. The resulting configuration, shown in FIG. 3, has gripping members 68 pressed together with spring 70 fully compressed. Gripping members 68 are then released, and resilience within spring 70 and bellows 21 causes bellows 21 to expand into the configuration shown in FIG. 2. As noted above, during expansion of bellows 21, air vent 66 allows air to enter chamber 64. In this manner, bellows 21 may be pumped a selected number of times to pump a desired amount of air into bubble 32.

In the embodiment of FIG. 2, a container 26 is separately provided for maintaining a supply of soapy liquid 29. Container 26 includes an open upper end 28 into which aperture 22 is dipped.

In FIGS. 3 and 4, an alternative embodiment of device 10 is shown. The embodiment of FIGS. 3 and 4 is similar to that of FIGS. 1 and 2, except that a container for holding soapy liquid is mounted directly within fuselage 15. Alternative container 72 includes a foam cap 74 covering an opening 76. Foam cap 74, shown more fully in FIG. 4, is constructed of a foam material of sufficient porosity to allow saturation by soapy liquid contained within container 72, while preventing substantial leaking of the soapy liquid from the container. Any of a number of conventional foam materials may be employed. A pair of crossing slits 78 are formed through foam cap 74. Slits 78 serve to collect additional portions of soapy liquid and to facilitate the collection of a soap film on aperture 22.

Container 72 is mounted within fuselage 15 by bracket members 80 and 82. Conduit 20 includes a flexible portion 83, which allows the free end of conduit 20 to bend upward, to an upper position shown in phantom lines. In the upper position, aperture 22 is disposed against foam cap 74, with aperture 22 partially penetrating slits 78.

With foam cap 74 saturated with a soapy liquid, a suitable soap film may be applied to cover aperture 22 by merely bending conduit 20 upward to the position shown in phantom lines. Once aperture 22 acquires a soap film, conduit 20 is bent downward to the resting position shown in solid lines in FIG. 3. Inflation of a soap-filled bubble then proceeds in accordance with the description provided with FIGS. 1 and 2.

Fuselage 15 may be provided with hinged openings to allow container 72 to be removed for storage or for refilling. Other hinged openings may be provided to allow access to the batteries and to the interior of the smoke-generating chamber. Also, foam cap 74 is preferably removable from container 72 to allow refilling of container 72. Although not shown, such may be achieved by providing container 72 with an outturned lip around opening 76 and providing foam cap 74 with an internal circumferential slot for engaging the outturned rim.

The embodiments shown in FIGS. 1–4 are but examples of a wide range of possible embodiments of the invention. The invention may be embodied in any suitable configuration having an aperture for receiving a soap film, means for conveying air through the aperture to inflate the soap film into a bubble, and a smoke-generating mechanism for producing smoke to be entrained within the air flow for filling the bubble with smoke.

For example, the device may be automated with an automatic air blower replacing manual air bellows 21. Likewise, an automated pumping mechanism may be connected to the container holding the soapy liquid to pump a suitable amount of the soapy liquid to the aperture without the need for manual dipping. Any of a number of alternative smoke-generating means may be employed. Also, an air pump means need not be used. Rather, conduit 23 may have an open free end such that air may be directly blown into the smoke-generating chamber by merely blowing into the free end.

Figure 5A:
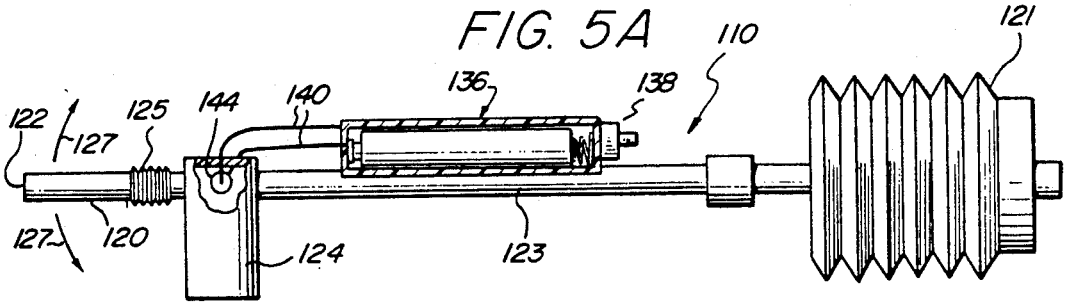
FIG. 5*a* is a side view, partially in cutaway, of an alternative embodiment of the invention.
Figure 5B:
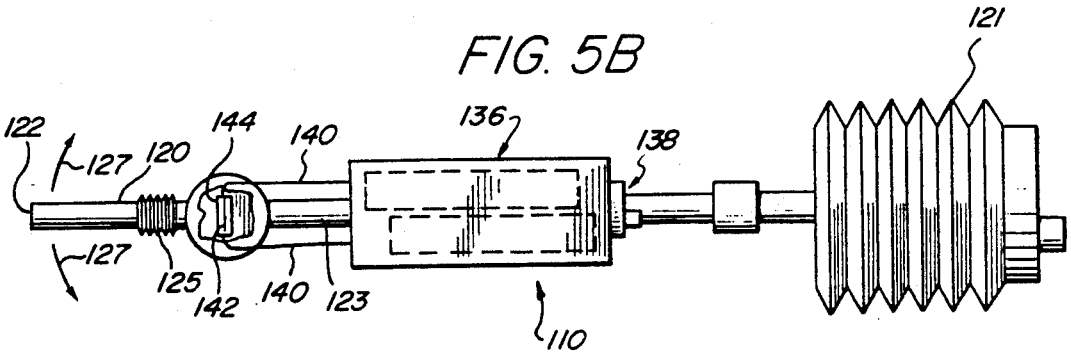
FIG. 5*b* is a top view, partially in cutaway, of the embodiment of FIG. 5*a*.

A simpler embodiment is shown in FIGS. 5*a* and 5*b*. A device 110 is shown including a tube or conduit 120 having an open aperture 122. An opposing end of conduit 120 is connected into a side of a smoke-generating chamber 124. A second conduit 123 connects an opposite side of chamber 124 to an air bellows 121. A pair of batteries 136 are mounted to an upper side surface of tube 123. Wires 140 connect batteries 136 to smoke-generating chamber 124. As with the embodiments of FIGS. 1–4, the smoke-generating chamber includes a filament 142 enclosed within an oil-soaked fibrous sheath 144, wherein the oil produces smoke in response to heat. A simple mechanical switch 138 is connected to batteries 136 to open and close a circuit connecting batteries 136 to filament 142 to produce smoke.

In use, bellows 121 is manually pumped to pump air through tube 123, chamber 124, and conduit 120 to inflate a soap film covering aperture 122. The soap film is achieved by merely dipping aperture 122 into a container of soapy liquid such as that shown in FIG. 1. Conduit 120 may include a bendable portion 125 provided to facilitate insertion of aperture 122 into a soapy liquid. Bendable portion 125 allows aperture 122 to be pivoted as shown by arrows 127. Bendable portion 125 is formed as an accordion-like section such as found in conventional bendable drinking straws.

The embodiment of FIGS. 5*a* and 5*b* is a particularly simple and inexpensive embodiment of the invention, yet includes all components necessary to produce a smoke-filled bubble.

Although shown and described as producing smoke-filled soap bubbles, the invention may easily be configured to produce other smoke-filled objects such as rubber or plastic balloons or bubbles. Any of a variety of expandable, inflatable, flexible films may be disposed over the aperture to produce a bubble-like or balloon-like object for receiving the smoke. In the case of a balloon, one merely mounts the open mouth of the balloon over aperture 122. Subsequent generation of smoke and pumping of air will cause the balloon to inflate with smoke-filled air.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A device for producing smoke-filled inflated, enclosed, flexible films, the device comprising:

a conduit terminating in an aperture;

a chamber for storing a soapy liquid, the chamber being disposed near the aperture of the conduit, said chamber including a foam cap enclosing an open end of the chamber, the foam cap being saturable by a portion of the soapy liquid, the foam cap having at least one slit;

means for allowing insertion of the aperture of the conduit into the slit of the chamber for collecting a soap film from the soapy liquid;

means for pumping a gas through the conduit past the aperture to inflate the soap film into a bubble; and smoke-generating means connected to the conduit for injecting smoke into the conduit while the soap film is inflated.

2. A toy for producing smoke-filled bubbles, the toy comprising:

an airplane-shaped housing, said housing having a pistol-grip handle;

a substantially enclosed soap chamber, mounted within the housing, for storing a quantity of soapy liquid;

conduit means terminating in an aperture for receiving a soap film from said soap chamber, said aperture positioned near a bottom surface of said housing;

air pump means, mounted within the housing, for selectively pumping air through the conduit past the aperture to inflate the soap film into a bubble, and smoke-generating means, mounted within the housing, for injection smoke into the conduit while the bubble is being inflated by the air pump means, the smoke thereby filling the bubble, the smoke-generating means including means for generating electrical current and means for producing smoke in response to the electrical current.

3. A toy for producing smoke-filled bubbles, the toy comprising:

an airplane-shaped housing, said housing having a downwardly-extending pistol-grip handle;

a substantially enclosed soap chamber, mounted within the housing, said chamber storing a quantity of soapy liquid;

a conduit having an end terminating in an aperture, said aperture receiving a soap film from said soap chamber, said end, protruding from a bottom surface of said housing;

an air pump, mounted within the housing, said air pump selectively pumping air through the conduit past the aperture to inflate the soap film into a bubble; and a smoke generator, mounted within the housing, said smoke generator injecting smoke into the conduit while the bubble is being inflated by the air pump means, the smoke thereby filling the bubble, said smoke generator including an oil which produces smoke in response to heat, and means for generating electrical current within a wire filament, said wire filament being in proximity to the oil, for heating the filament, to thereby heat the oil and generate smoke.

* * * * *